US009352480B2

(12) United States Patent
Belzile

(10) Patent No.: US 9,352,480 B2
(45) Date of Patent: May 31, 2016

(54) PORTABLE SAW MILL WITH BED ADJUSTMENTS

(75) Inventor: Luc Belzile, Shediac Cape (CA)

(73) Assignee: Wood-Mizer, LLC, Indianapolis, IN (US)

( * ) Notice: Subject to any disclaimer, the term of this patent is extended or adjusted under 35 U.S.C. 154(b) by 770 days.

(21) Appl. No.: 13/610,627

(22) Filed: Sep. 11, 2012

(65) Prior Publication Data

US 2013/0283992 A1 Oct. 31, 2013

Related U.S. Application Data

(60) Provisional application No. 61/639,913, filed on Apr. 28, 2012.

(51) Int. Cl.

| | |
|---|---|
| ***B27B 13/00*** | (2006.01) |
| ***B27B 13/02*** | (2006.01) |
| ***B27B 15/02*** | (2006.01) |

(52) U.S. Cl.

CPC ..... *B27B 13/00* (2013.01); *B27B 13/02* (2013.01); *B27B 15/02* (2013.01); *Y10T 83/707* (2015.04); *Y10T 83/722* (2015.04); *Y10T 83/889* (2015.04)

(58) Field of Classification Search

CPC ..... B27B 13/00; B27B 15/02; B27B 13/02; B23D 53/026; B23D 55/02

USPC ..... 269/289 R; 83/648, 809, 813

See application file for complete search history.

(56) References Cited

U.S. PATENT DOCUMENTS 4,589,320 A * 5/1986 Kaster ..... 83/794

* cited by examiner

*Primary Examiner* — Lee D Wilson
*Assistant Examiner* — Jamal Daniel
(74) *Attorney, Agent, or Firm* — Maginot Moore & Beck LLP

(57) ABSTRACT

A log adjustment system for a portable saw mill having a saw head and a bed includes a pair of substantially parallel elongate supports, at least two transverse members, and an adjustable toe board. The first transverse member extends between the elongate supports. The second transverse member extends parallel to the first transverse member. The adjustable toe board extends in a gap defined between the first transverse member and the second transverse member. The adjustable tool is configured to be supported at a plurality of heights adjacent to the first and second transverse members.

17 Claims, 14 Drawing Sheets

PORTABLE SAW MILL WITH BED ADJUSTMENTS

This application claims the benefit of U.S. Provisional Patent Application Ser. No. 61/639,913, filed Apr. 28, 2012, which is incorporated herein by reference.

CROSS-REFERENCE TO RELATED APPLICATION

Cross-reference is made to my co-pending patent application, U.S. application Ser. No. 13/610,605, filed on Sep. 11, 2012.

FIELD OF THE INVENTION

The present invention relates to saw mills, and more specifically, to portable saw mills.

BACKGROUND

In the lumber industry, logs are cut into boards at saw mills. Commercial saw mill plants are typically large, complex installations operations with large sawing fixtures and machines, often including log and board conveyor mechanisms. Such commercial saw mills are capable of cutting up to and exceed one million board feet in a single day. In contrast to such large mill plants, portable saw mills satisfy a different market. Portable saw mills are smaller scale saw mills that may be moved to locations near the source of the logs. In addition, portable saw mills allow for hobbyists and craftsman to generate their own cut lumber.

In general, portable saw mills include a saw head, a carriage, and a bed. In use, a log is disposed on the bed lengthwise. An operator then moves the saw head, using the carriage, along the length of the log. The saw head itself includes a continuous band saw blade wound around two rotating band wheels. The saw head also includes a saw head housing enclosing rotating band wheels and non-cutting sections of the saw blade. The portion of the blade that engages the timber is external to the saw head housing. The saw head is affixed to the carriage, thereby allowing for relative movement of the blade with respect to the timber to be cut. The saw head also includes a gasoline-powered engine or some other prime mover of the blade.

A typical portable saw mill bed includes two elongated, parallel rails having a plurality of cross-braces known as bunks. The lumber to be cut is supported on the bunks. To this end, the bed includes further features, such as posts that provide lateral support to the log. The lateral support posts are positioned at a height that allows the saw head to safely pass over without interference. In order to facilitate cuts at different heights, the lateral support posts are typically vertically adjustable. Such lateral support posts, however, often included complex hydraulic members or other relatively complex structures to facilitate the support and vertical adjustment.

In addition, it is known to include height adjusting elements that assist in leveling logs. Such structures can also be complex adjustment structures. The complex structures add cost and inconvenience to the user.

There is a need, therefore, for bed structures for use in a saw mill such as a portable saw mill that have reduced complexity and costs.

SUMMARY

Embodiments of the present invention implement a bed and bunk structure in combination with one or more support attachments in a portable saw mill having reduced complexity and/or cost.

A first embodiment involves an adjustable toe board system. In this embodiment, a log adjustment system for a portable saw mill includes a pair of substantially parallel elongate supports, first and second transverse members extending between the elongate supports, and an adjustable toe board. The adjustable toe board extends in a gap defined between the first transverse member and the second transverse member. The adjustable tool is configured to be supported at a plurality of heights adjacent the first and second transverse members.

Another embodiment relates to a log support arrangement for a portable saw mill having a saw head and a bed. The arrangement includes a first fixture and a vertical support member. The first fixture is affixed to the bed, and has a central opening. The vertical support member is disposed with at least a portion passing through the central opening. The vertical support member including a plurality of teeth configured to engage at least one edge of the fixture adjacent the central opening. The central opening also includes an extended open portion configured to allow the teeth to pass vertically during vertical movement of the vertical support member.

The above-described features and advantages, as well as others, will become more readily apparent to those of ordinary skill in the art by reference to the following detailed descriptions and accompanying drawings.

DETAILED DESCRIPTION

Figure 1:
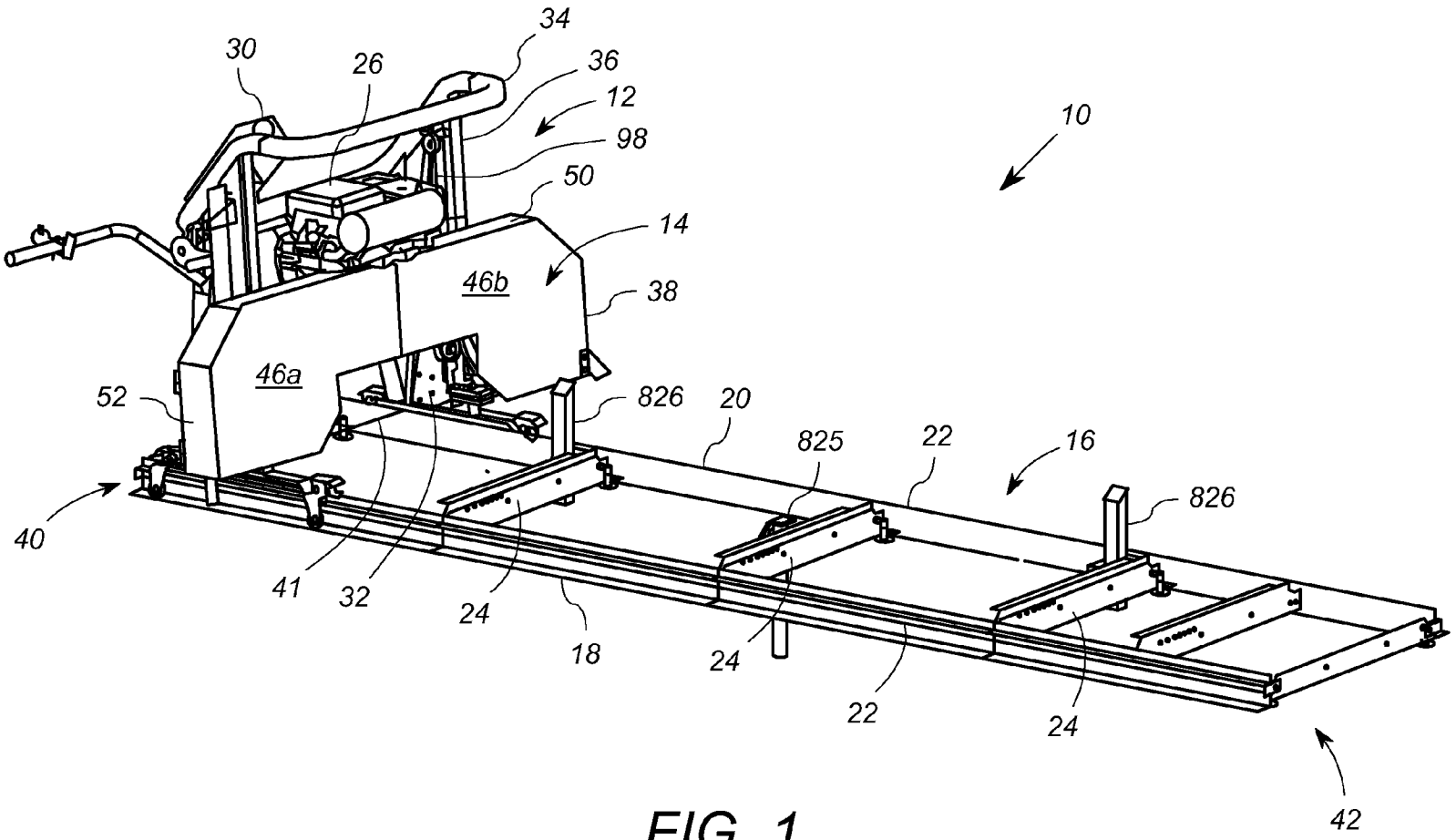
FIG. 1 shows a perspective view of an exemplary portable saw mill that incorporates a first embodiment of the invention.

FIG. 1 shows a perspective view of an exemplary portable saw mill 10 that incorporates embodiments of various inventive features. The portable saw mill 10 includes a carriage 12, a saw head 14 and bed 16. The bed 16 includes first and second parallel rails 18, 20 defining a longitudinal direction of the saw mill 10. A track 22 is affixed to the upper portion of each of the rails 18, 20. The rails 18, 20 are interconnected by a series of transverse bunks 24, such that the rails 18, 20 and the bunks 24 define the rough general appearance of a ladder. The transverse bunks 24 ensure consistent parallel spacing between the rails 18, 20, and hence the tracks 22.

The carriage 12 is disposed on the tracks 22, and is configured to move longitudinally along the tracks 22. The saw head 14 is affixed to the carriage 12 and thus is configured to move longitudinally therewith. The carriage 12 also includes and/or supports an engine 26, a saw blade lubrication unit 30, and multiple reinforcement structures 32, 34, 36.

The saw head 14 includes a housing 38 in which several structures, many of which are not shown in FIG. 1, are disposed. These structures include a saw blade 41, two spindles or band wheels on which the saw blade 41 is mounted, a support member, and portions of lubrication, braking and drive mechanisms.

In the general operation of the saw mill 10, an operator positions timber or lumber to be cut lengthwise along bed 16 between the rails 18, 20, such that the log rests on at least two of the bunks 24. When positioning the log, the carriage 12 is disposed at a first end 40 of the saw mill 10. One or more structures of, or attached to, one or more of the bunks 24 are used to hold the log in place. Such structures include a log dog assembly 825 and vertical side support members 826, discussed further below in connection with FIGS. 7-14.

The log dog assembly 825 and the vertical side support members 826 are dispersed along different bunks 24 in the direction of the second end 42 of the saw mill 10. To effectuate the board cutting operation, the log or timber, not shown, is held between the log dog assembly 825 and the vertical side support members 826. The operator moves the carriage 12 and hence the saw head 14 along the tracks 22 in the direction from the first end 40 to the second end 42. Before such movement, however, the operator actuates the engine 26 and performs other operations that couple the output of the engine 26 to the blade 41. Details regarding suitable mechanisms for the transfer of power from an engine 26 to a saw blade 41 in a portable saw mill are known in the art. Further detail regarding the embodiment described herein, which includes additional useful features, is provided below in connection with FIGS. 2 and 3.

Once the engine 26 power drives the blade 41, the operator moves the carriage 12 and saw head 14 along the tracks 22. The blade 41 engages the timber or lumber, not shown, and performs the cut operation as is known in the art. In accordance with this embodiment of the present invention, the reinforcement member within the housing 38, not shown in FIG. 1, provides the support for stiffening of the housing 38 and overall saw head 14. Such support is carried out without relatively expensive external structures.

Figure 2:
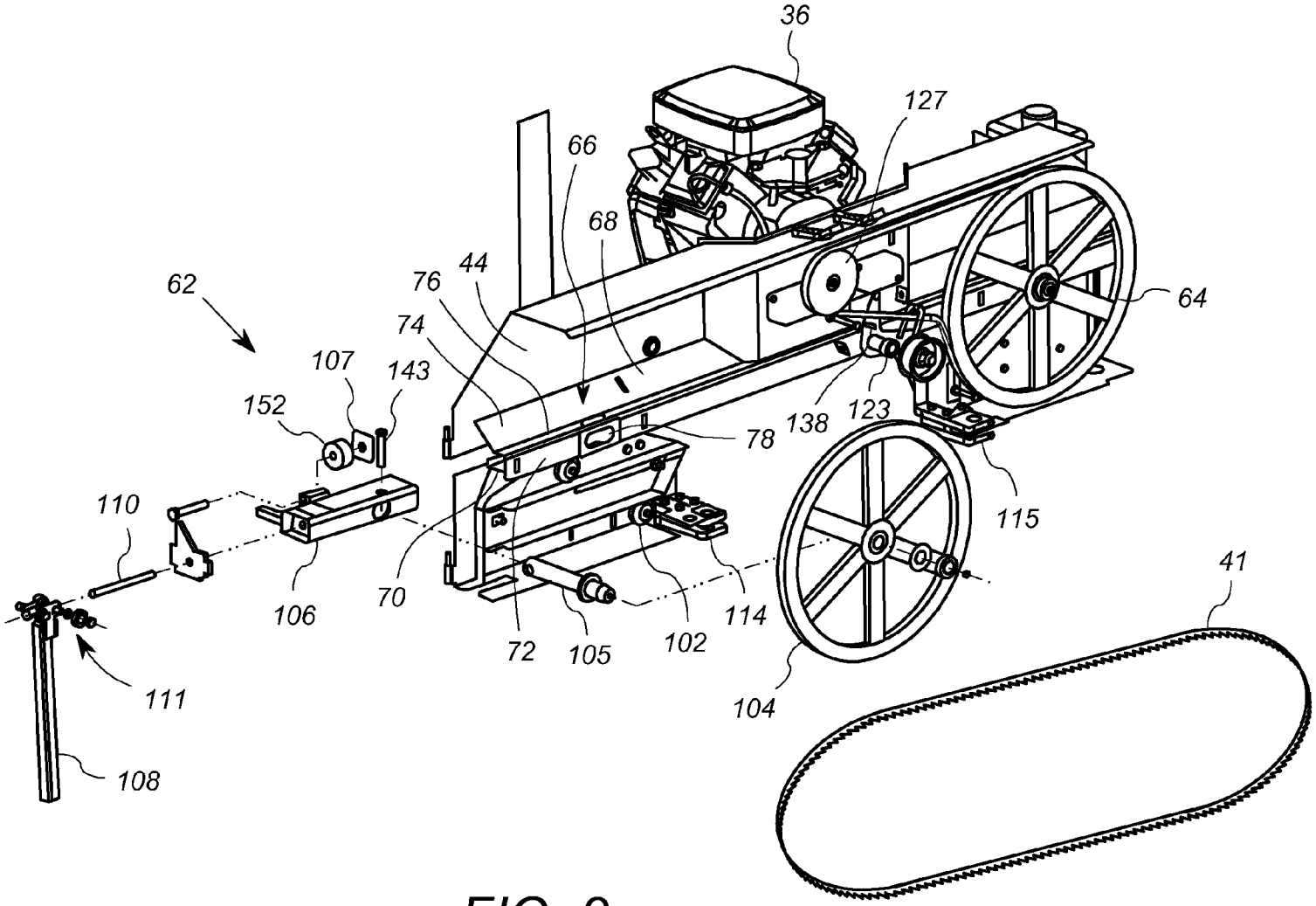
FIG. 2 shows an exploded perspective front view of the saw head of the portable saw mill with portions of its housing removed to reveal the components disposed therein.
Figure 3:
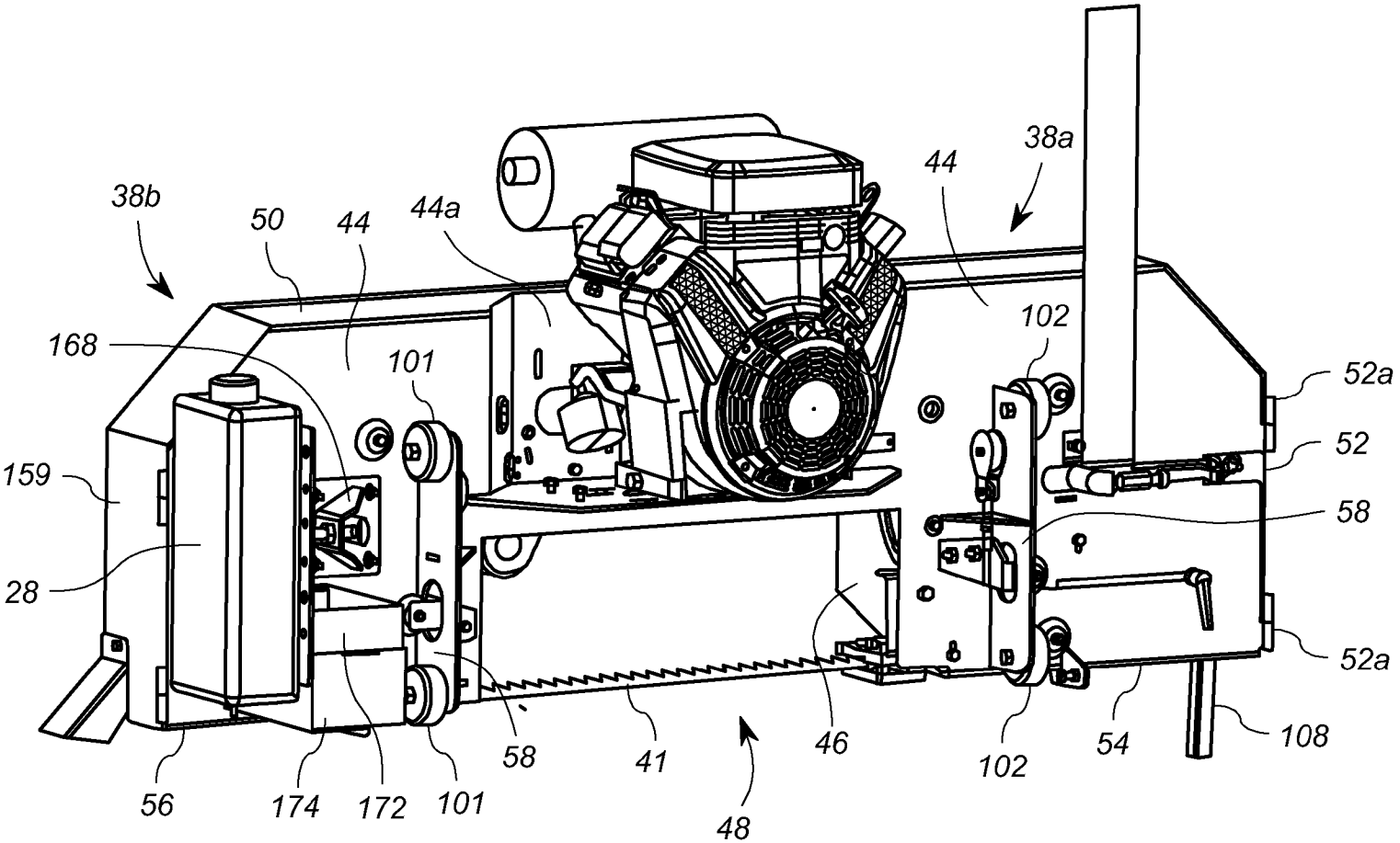
FIG. 3 shows an exploded perspective rear view of the saw head of FIG. 2.
Figure 4:
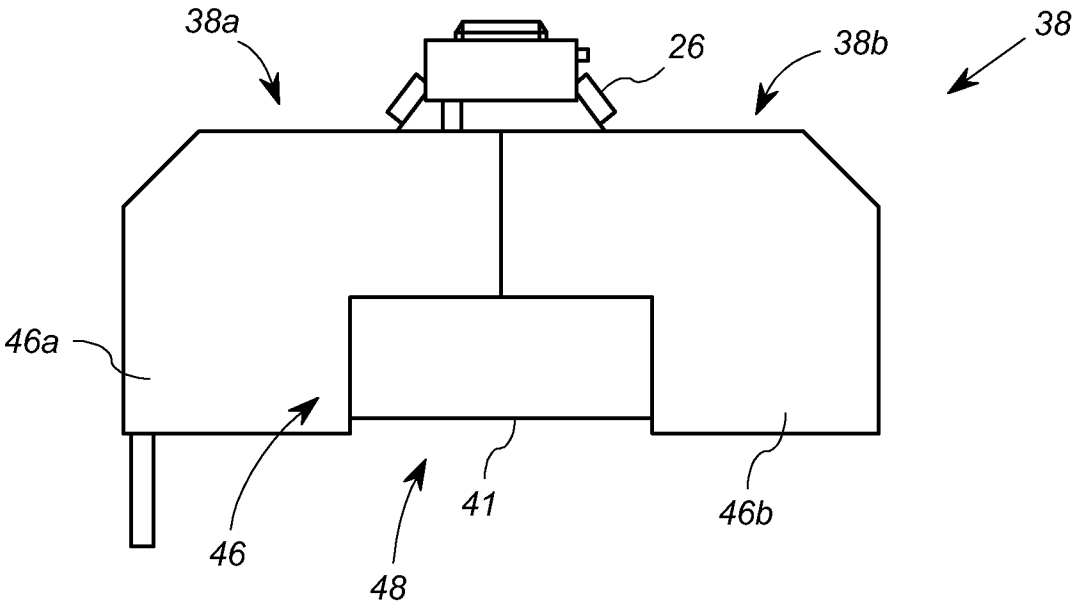
FIG. 4 shows a front plan view of the saw head of FIG. 2.

FIGS. 2, 3 and 4 show in further detail the saw head 14 that incorporates an exemplary embodiment of the invention. FIG. 2 shows an exploded perspective front view of the saw head 14 with portions of the housing 38 removed to reveal the components disposed within the housing 38. FIG. 3 shows a perspective rear view of the saw head 14. FIG. 4 shows a front plan view of the saw head 14. In general, reference to FIGS. 2, 3 and 4 will be made simultaneously.

As shown in FIGS. 3 and 4, the housing 38 has the general shape of a downward facing "C" or that of an inverted, truncated, "U". The interior void of the "C" or "U" shaped housing 38 is referred to herein as the work space 48, and represents the space in which the blade 41 interacts with the lumber or timber, not shown.

The housing has a rear wall 44 (see FIGS. 2 and 3) and a front wall 46 (see FIG. 4), both of essentially the same downward "C" or inverted "U" shape. The rear wall 44 and front wall 46 extend substantially parallel to each other, and are separated by a corresponding downward "C" or inverted "U" shaped interior space. The housing 38 further includes a series of side walls 50, 52, 54, 56, 159 (see also FIG. 1) that extend along and between entire peripheries of the rear wall 44 and the front wall 46, with the exception portion of the periphery adjacent the work space 48, which is left open to allow the saw blade 41 to pass from the interior of the housing 38 through the work space 48.

In this embodiment, the front wall 46 is made up of a plurality of sections, at least two of which are moveable to allow access to the interiors of left and right portions 38*a*, 38*b*, respectively, of the housing 38.

More specifically, as shown in FIG. 4, the front wall 46 includes a first portion 46*a*, and a second portion 46*b*. Referring to FIGS. 1, 3 and 4, in this embodiment, the first portion 46*a* is moveable by its integrally formed connection with the side wall 52, which in turn is hingedly connected to the rear wall 44. To this end, as shown in FIG. 3, hinges 52*a* connect the side wall 52 and hence the first portion 46*a* of the front wall 46 to the rear wall 44. Similarly, the second portion 46*b* is moveable by its integrally formed connection with the side wall 159, which in turn is also hingedly connected to the rear wall 44. In essence, the first portion 46*a* and the side wall 52 may be "opened" as a unit to allow access to the interior of the left portion 38*a* of the housing. Likewise, the second portion 46*b* and the side wall 159 may be "opened" as a unit to allow access to the interior of the right portion 38*b* of the housing 38.

Referring again to FIG. 3, the rear wall 44 includes an indented portion 44*a* that is disposed above the work area 48 opposite a center area of the front wall 46. The engine 26 is mounted on the external side rear wall 44 partially within the void formed by the indented portion 44*a*. The engine 26 is preferably a gas powered internal combustion engine having approximately 18-25 hp.

It will be appreciated that "right" and "left" are consistently used herein from the perspective viewing the front of the saw head 14, as shown in FIGS. 2 and 4. Accordingly, "right" and "left" appear reversed in FIG. 3, because it comprises a rear view.

Also mounted on the external side of the rear wall 44 are vertical track roller brackets 58, a fuel tank bracket 174, a battery 172, and a swivel sheave assembly 129. The vertical track roller brackets 58 are disposed to the left and right of the work area 48. A pair of rollers 101 is rotatably attached to each of the vertical track roller brackets 58. The rollers 101 and brackets 58 are configured such that the rollers 101 align with vertical tracks 220 on the carriage 12 to facilitate vertical adjustment of the saw head 14. Another set of rollers 102 are connected rotatably coupled to the back panel 44.

In this embodiment, the fuel tank 28 is mounted adjacent the external side of right portion of the rear wall 44 via the fuel tank bracket 174. The swivel sheave assembly 129 provides a pulley mechanism for receiving a cable, not shown in FIGS. 2 and 3, that is used to vertically adjust the saw head 14 on the carriage 12. Further detail regarding the vertical adjustment of the saw head 14 is provided below in connection with FIG. 5.

Referring to FIG. 2, the saw head 14 further includes a blade tensioner unit 62, a first band wheel 104, a second band wheel 64, the blade 41, blade guides 114 and 115, a drive sheave 127, a drive belt 138, a clutch assembly 123, and a reinforcement member 66. All of the above-listed components, with the exception of portions of the blade tensioner unit 62, are disposed in the interior of the housing 38, and more specifically, between the rear wall 44 and the front wall 46, not shown in FIG. 2.

The blade 41 is a conventional band saw blade consisting of a length of a flat sheet of steel with corresponding saw teeth as is known in the art. The long band of the blade 41 is formed into a continuous oval shape that adapted to fit around and between the first band wheel 104 and the second band wheel 64. The first band wheel 104 is rotatably attached to the blade tensioner unit 62 via a spindle 105. The second band wheel 64 is rotatably attached to a corresponding bracket 168 mounted to the rear wall 44 behind the reinforcement member 66. (See also FIG. 3).

The reinforcement member 66 is formed of a sheet of steel or similar metal. The reinforcement member 66 extends widthwise across over half of the width of the rear wall 44, and preferably over 90% of the width of the rear wall, as shown in FIG. 2. The reinforcement member 66 is welded or otherwise affixed to the rear wall 44, and as discussed above, is disposed between the rear wall 44 and the front wall 46.

The reinforcement member 66 includes at least first and second walls 68, 70 having a length dimension that runs parallel to the width (left to right) of the rear wall 44. Each of the walls 68, 70 are continuous and integrally formed. Each of the walls 68 and 70 also extends widthwise from the rear wall 44 in the direction toward the front wall 46. In addition, the reinforcement member 66 further includes a third wall 72 having a length dimension that runs parallel to the lengths of the first and second walls 68, 70. The third wall 72 is spaced apart from at least a majority of the rear wall 44 and from the front wall 46. The third wall 72 furthermore extends between the first and second walls 68, 70. In this embodiment, the third wall 72 is lies in a plane that is substantially parallel to that of a majority of the rear wall 44.

Because they are interconnected and run in a parallel manner, the first, second and third walls 68, 70, 72 may suitably be formed of single sheet of steel, with fold lines defining the intersection of the first wall 68 and the second wall 70, and the intersection of the second wall 70 and the third wall 72. The long side edges of the sheet (the side edges of the first wall 68 and the third wall 72) are welded to the interior side of the rear wall 44. Accordingly, the reinforcement member 66 and the rear wall 44 cooperate to form a hollow space therebetween.

In the embodiment described herein the first wall 68 further includes an inclined portion 74 that extends downward from the rear wall 44 as well as outward, and a short flat portion 76 that extends in a plane that is normal to those of the rear wall 44 and the third wall 72 of the reinforcement member 66. The second wall 70 in this embodiment extends from the rear wall 44 to the third wall 72 in a plane that is normal to those of the rear wall 44 and the third wall 72 of the reinforcement member 66.

The reinforcement member 66 differs from the rear tube reinforcement structure of the prior art for at least two reasons. Firstly, the reinforcement member 66 of this embodiment is disposed in the interior of the housing 38, and not rear of the rear wall 44. Secondly, the reinforcement structure may be composed of sheet steel, as opposed to a piece of steel tube, thereby reducing cost in the structure of the saw mill 10.

As discussed above, the blade 41 fits around the band wheels 104, 64. The blade 41 is also fitted through the blade guides 114, 115. The blade guide 114 comprises opposing flat plates that extend horizontally from the rear wall 44, and are spaced to receive the blade 41 horizontally therethrough. The blade guide 114 is dispose on the bottom of the left housing section 38*a* adjacent the work space 48. The blade guide 115 has a substantially similar structure as the blade guide 114, but is disposed on the bottom of the right housing section 38*b* adjacent the work space 48.

As discussed above, the band wheel 104 is rotatably attached to a spindle 105, which is in turn mounted to the blade tensioner unit 62. The blade tensioner unit 62 includes a base block 106, an inside nut 107, a tensioner handle 108, a rod 110, a cam assembly 111, and a tension spring 152. In general, the spindle 105 is secured by the inside nut 107 within the base block 106. The base block 106 is disposed in the hollow space between the reinforcement member 66 and the rear wall 44. To allow the spindle to extend out of the hollow space, the third wall 72 of the reinforcement member 66 includes an opening 78. The spindle 105 thus extends between the band wheel 104 and the base block 106 through the opening 78.

The base block 106 is configured to move back and forth within the space between the reinforcement member 66 and the rear wall 44 by movement of the tensioner handle 108. The tensioner handle 108 is an elongate metal structure pivotally attached at one end by the cam assembly 111. The tensioner rod 110 extends from the tensioner handle 108 to the inside nut 107. The cam assembly 111 is configured to move the tensioner handle 108 such that the rod 110 moves back and forth along the rear wall 44, thereby moving the base block 106 and spindle 105 in the same manner. The cam assembly 111 is further configured to "lock" the tensioner handle 108 in a downward position. It will be appreciated that the opening 78 in the reinforcement member 66 is in the form of an oval to allow for linear movement of the spindle 105.

In general, the blade tensioner unit 62 is configured to move the spindle 105 between a blade tension position and a blade release position by rotating the tensioner handle 108. Specifically, when the tensioner handle 108 is rotated, the blade tensioner unit 62, via the cam 111 and the rod 110, creates a linear movement of the spindle 105 toward or away from the direction of the second band wheel 64. As the spindle 105 moves, the first band wheel 104 moves.

More specifically, when the tensioner handle 105 is rotated upward, the rod 110 moves the first band wheel 104 toward the second band wheel 64, thereby releasing tension on the blade 41. When the tensioner handle 105 is rotated downward, the rod 110 moves the first band wheel 104 away from the second band wheel 64, thereby increasing tension on the blade 41. The cam 111 provides a retention force when the handle 105 is in the vertically downward (tensioned) position, thereby "locking" the first band wheel 104 in the blade tension position.

Accordingly, in addition to general structural reinforcement, the reinforcement member 66 further cooperates with the rear wall 44 to form a linear track or guide for the base block 106 of the blade tensioner unit 62. In this way, the reinforcement member 66 of the embodiment described herein provides two separate functions with a single structure, thereby further reducing the part count, cost, and size of the device as compared with other designs having similar functionality.

The blade drive train includes the engine 26, a drive sheave 127, a drive belt 138, the clutch assembly 123, and the second band wheel 64. The drive sheave 127 is operably connected to rotate with the rotation of the output shaft, not shown, of the engine 26. The drive belt 138 extends around the drive sheave 127 and the second band wheel 64. The clutch assembly 123 operates to selectively and alternatively tighten or loosen the drive belt 138 about the drive sheave 127 and second band wheel 64.

In general, when the clutch assembly 123 is engaged, the engine 26 drives the drive sheave 127. The rotating drive sheave 127 moves the drive belt 138, which in turn drives the second band wheel 64. The rotating second band wheel 64 thus moves the blade 41, which further rotates about the free spinning first band wheel 104, assuming the first band wheel 104 is in the blade tension position as discussed above.

It will be appreciated that many of the details of particular structures of clutch assembly 123 and various other devices would be known to those of ordinary skill in the art, and may take many suitable forms. Such details have been omitted for clarity of exposition.

Referring again to FIG. 1, the carriage 12 in general constitutes an assembly that allows the saw head 14, and hence the blade 41, to move horizontally to saw lumber. In this embodiment, the carriage 12 further allows the saw head 14, and hence the blade 41, to be adjusted vertically.

Figure 5:
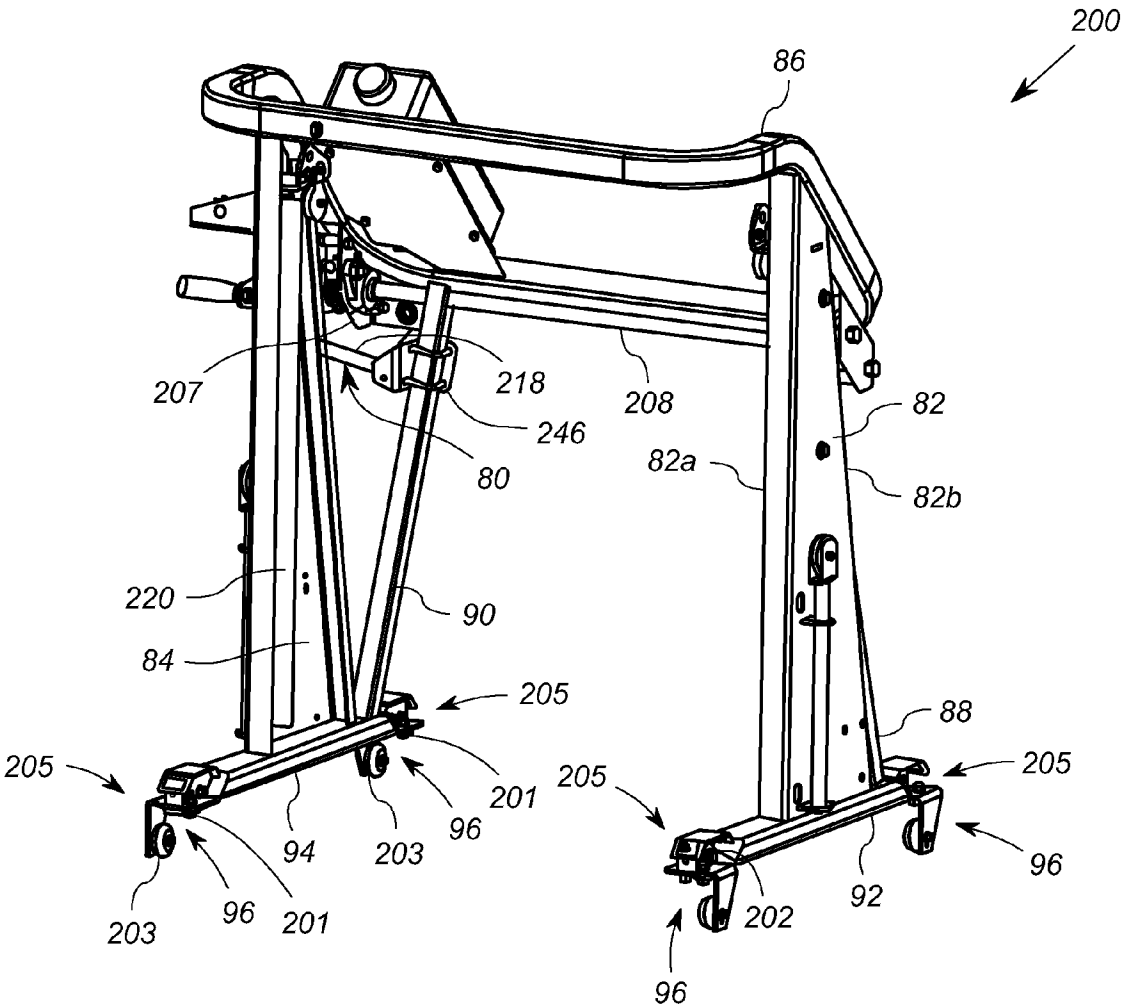
FIG. 5 shows a front perspective view of an exemplary embodiment of the carriage of the portable saw mill of FIG. 1 apart the saw head and the bed.
Figure 6:
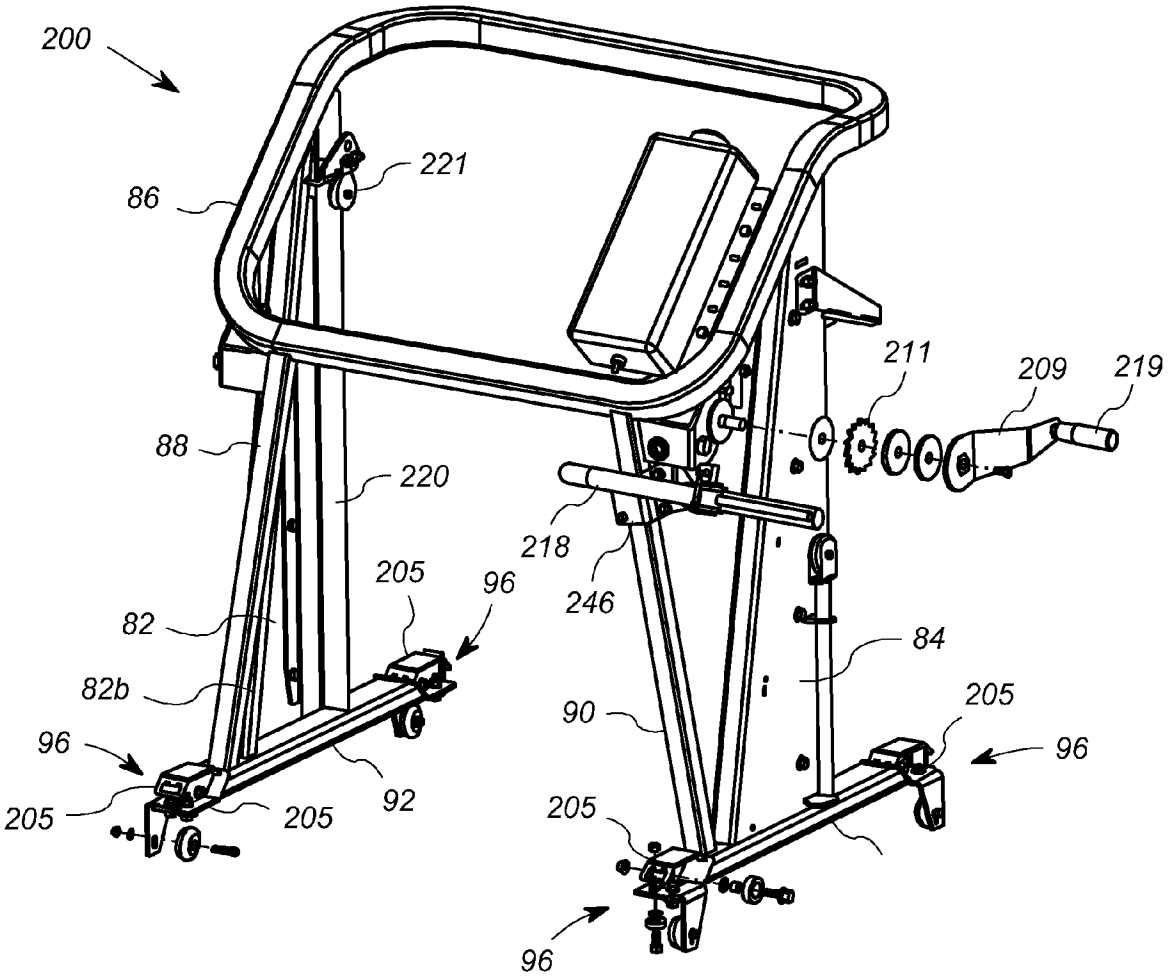
FIG. 6 shows a rear perspective view of the carriage of the FIG. 5 apart from the saw head and the bed.

FIGS. 5 and 6 show front and rear perspective views of the carriage 12 apart from the remainder of the saw mill 10. The saw head 14 has been removed from the carriage 12 in FIGS. 5 and 6. FIG. 5 shows the front perspective view of the carriage 12, illustrating the direction looking back to the direction of the first end 40 of the saw mill 10 in FIG. 1. By contrast, FIG. 6 shows the rear perspective view, from the point of view of the operator, not shown.

With reference to both FIGS. 5 and 6, the carriage 12 includes a frame 200, a winch system 80 and a plurality of bearing/wheel assemblies 96. The frame 200 includes upright supports 82, 84, an upper support 86, rear supports 88, 90 and two wheel supports 92, 94. Each of the upright supports 82, 84 is a roughly trapezoidal-shaped sheet metal structure with edge flanges providing structural strength. More specifically, the upright support 82 is elongated vertically with a substantially vertical, flanged front edge 82*a* adjacent the location of the saw head 14 (not shown in FIG. 5), and with an inclined, flanged rear edge 82*b*. The upright support 82 extends from the wheel support 92 to the upper support 86 and is wider at the bottom adjacent the wheel support 92. The upright support 84 has an analogous structure and extends from the wheel support 94 to the upper support 86, opposite the upright support 82.

The upper support 86 is preferably formed of one or more tubular steel pieces and in any event defines a roughly rectangular loop. The tubular steel loop extends from the front to the back of the carriage 12, across the width of the carriage 12, back to the front, and then back across the width of the carriage 12. The loop formed by the upper support 86 also is disposed at an inclined angle the inclines from back to front.

The rear support 88 is a steel support structure extending upward from the wheel support 92 to the rear portion of the upper support 86 in a manner that is inclined from back-to-front and inwardly. The rear support 90 is a similar steel support structure extending upward from the wheel support 94 to the rear portion of the upper support 86 in a manner that is inclined both back-to-front and inwardly.

The wheel supports 92, 94 are disposed spaced apart from each other, and are essentially aligned with the rails 20, 18, respectively, of the bed 16. (See also FIG. 1). Each wheel support 92, 94 supports two bearing/wheel assemblies 96. The bearing/wheel assemblies 96 include a main support bearing 202, a side guide bearing (or two) 201, an anti-lift wheel 203, and corresponding support/bushing assemblies 205. The main support bearing 202 engages the top of the track 22, the side guide bearing(s) 201 engage the sides of the track 22, and the anti-lift wheel 203 engages the bottom of the track 22 as necessary to prevent one or both sides of the frame 200 from lifting from the track 22 during use. The support/bushing assemblies 205 secure the various bearings 201, 202 and 203 to the wheel supports 92, 94 in a manner that allows rotation of the bearings 201, 202 and 203. Additional details of suitable bearings 201, 202, 203 and the corresponding suitable support/bushing assemblies 205 would be known to those of ordinary skill in the art.

The winch system 80 is a system by which an operator may raise and lower the saw head 14 to effectuate cutting at different vertical levels. As shown in a combination of FIGS. 5 and 6, the winch system 80 in this embodiment includes a winch shaft 208, a winch shaft bearing 207, a crank lever 209, a brake ratchet wheel 211, and two swivel sheave blocks 221. The winch system 80 also includes cables 98, not shown in FIGS. 5 and 6. (See FIG. 1). In general, the winch shaft 208 rotates to wind or unwind the cables 98, which are affixed to the saw head 14 via the swivel sheave blocks 221 and saw head swivel sheave assemblies 129 (see FIG. 3). A first end of the cable 98 is secured to the winch shaft 208, and the other end of the cable 98 is secured in a suitable manner. The winch shaft 208 extends across the width of the frame 200 and is near a top area of the side supports 82 and 84. The crank lever 209 includes an operator handle 219 and connecting lever arm that are operably connected to rotate the winch shaft 208. The ratchet brake 211 is operably connected between the crank lever 209 and the winch shaft 208 to enable locking of the winch shaft 208 when the saw head 14 is in a desired vertical position. Further implementation and structural details of suitable embodiments of the winch system 80 are conventional.

The frame 200 of the carriage 12 also includes a first vertical track 220 (FIG. 5) and a second vertical track 220 (FIG. 6), for engaging the rollers 101, 102 of the saw head 14. Referring to FIG. 5, the first vertical track 220 is a flat steel structure extending inward toward the center of the frame 200 with a flange, not shown, for securing the track 220 to the vertical support 84. The first vertical track 220 extends vertically from proximate the wheel support 94 to the level of the winch shaft 208. The second vertical track 220 of FIG. 6 has a similar structure and is secured to the vertical support 82. The frame 200 further includes a push handle 218 (See also FIG. 1) secured to the rear support 90 by a suitable bolt-on bracket 246.

It will be appreciated that many conventional details and/or other features not germane to the inventive aspects described herein have been omitted for clarity of exposition. Portable saw mills may have multiple features that may be implemented in a plurality of ways without departing from the scope of the invention.

Thus, for example, the various novel elements of the embodiment described above, including but not limited one or more of those of the reinforcement member 66, and the arrangement of elements in the carriage 12 and the saw head 14, may be employed on any saw mill without respect to the specific structure of the bed 16.

Figure 7:
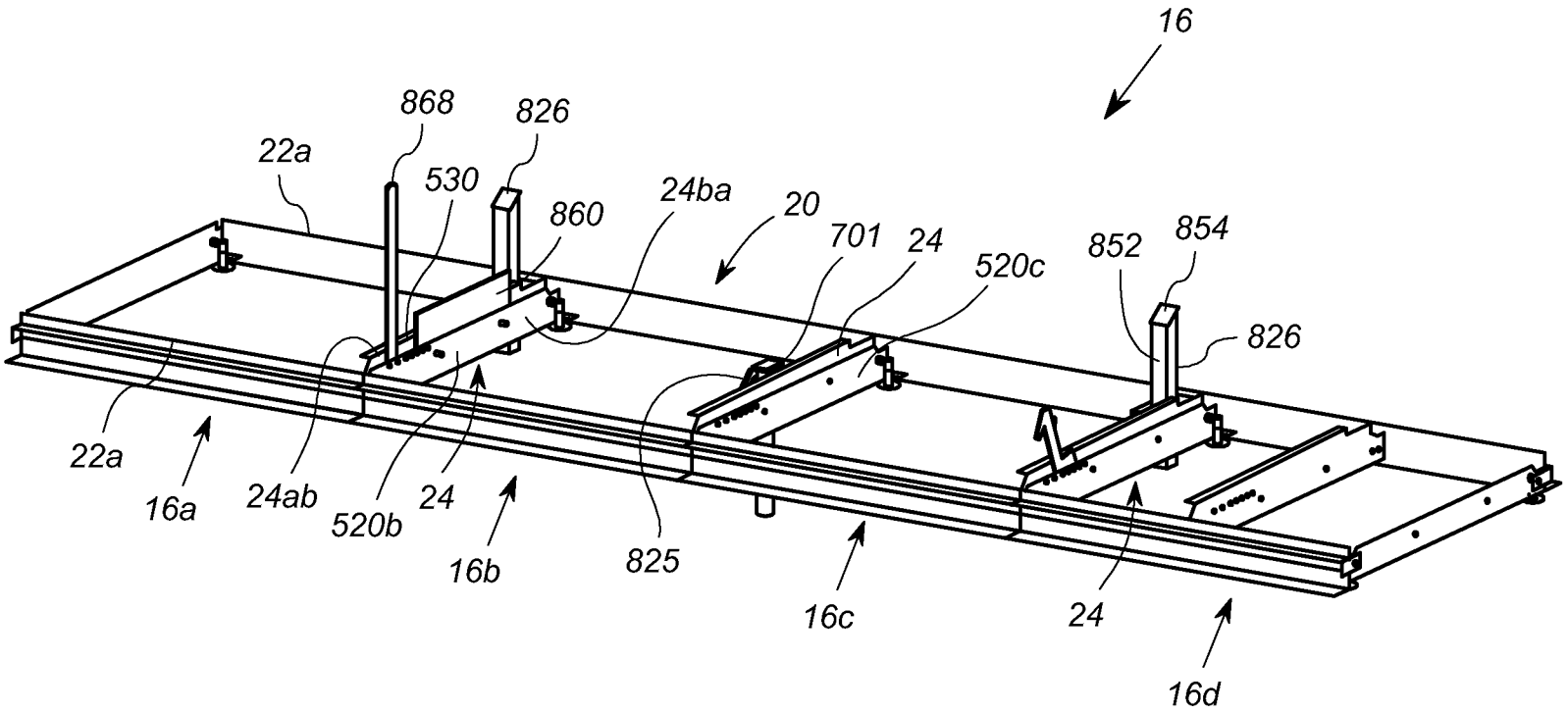
FIG. 7 shows a perspective view of the bed of the saw mill of FIG. 1.

Nevertheless, the bed 16 includes additional novel features which will be described herebelow. These features are generally shown in FIG. 1 and FIG. 7. FIG. 7 shows a perspective view of the bed 16 apart from the carriage 12 and saw head 14.

Referring again generally to FIGS. 1 and 7, as discussed above, the bed 16 includes the first and second rails 18, 20 and the plurality of bunks 24. The first and second rails 18, 20 comprise elongate, parallel, rigid members, preferably but not necessarily formed from steel. As will be discussed below, the bunks 24 are made up of two separate elements, with some incorporating structure features to facilitate one or more functional attachments.

Three main structures associated with the bed 16 that operate to position and secure logs and timber include a dog assembly 825, a set of vertical side support members 826 and one or more toe boards 860 (see FIG. 7). In general, the dog assembly 825 is a transversely adjustable clamping mechanism that is used to hold the log or timber against the vertical side support members 826. The toe board 860 can be used to raise one end of the log, for example, to account for the inherent taper of flitches (logs for cutting). In particular, because logs have a natural taper, it is sometimes advantageous to raise the thinner end of the log to effectuate a straight cut. The toe board 860 is used to raise the thinner end of the log, and is preferably adjustable to different heights, as will be discussed below in connection with FIGS. 9, 11*a*, 11*b* and 12.

Figure 8:
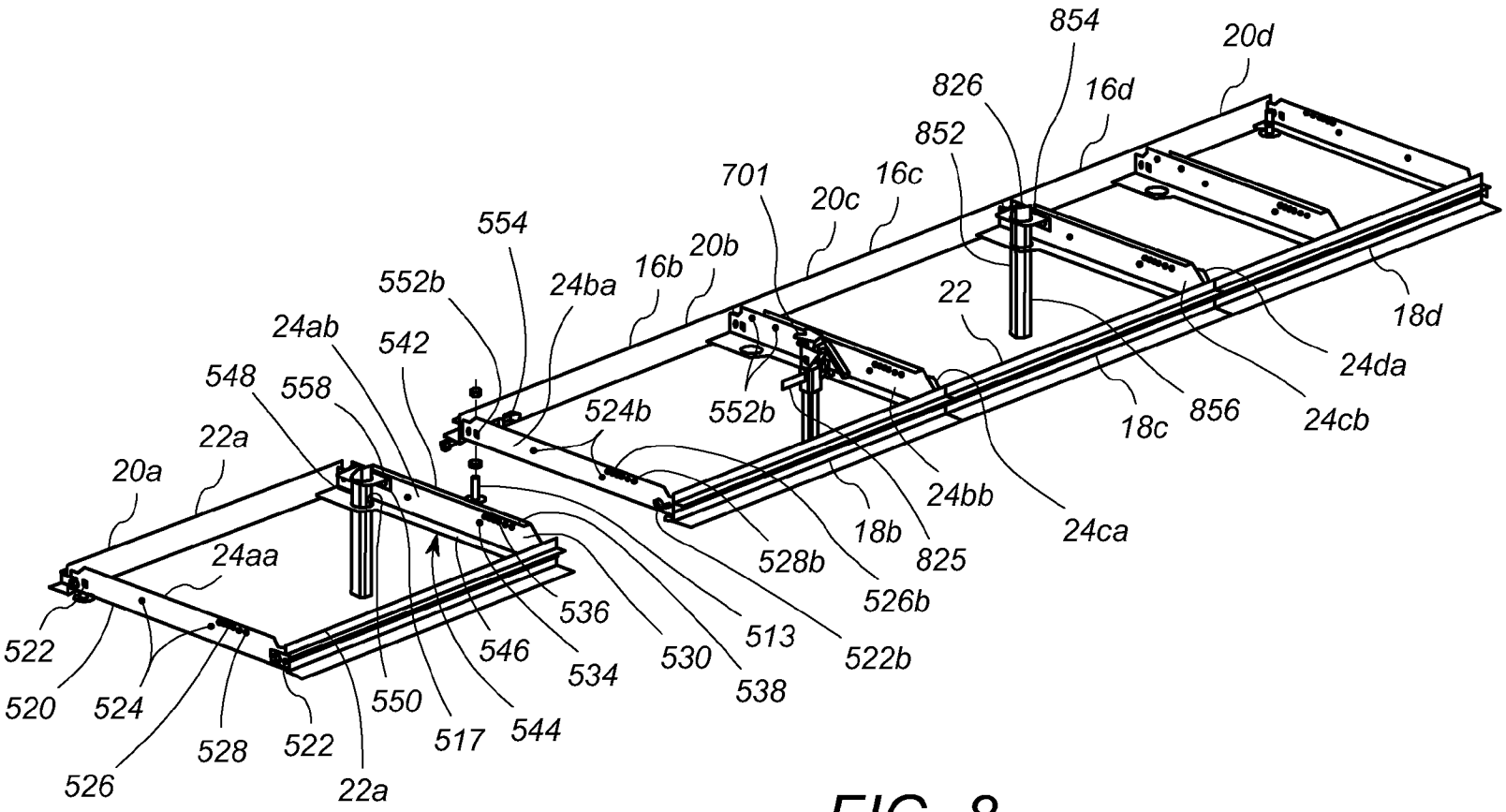
FIG. 8 shows another perspective view of the bed of the saw mill of FIG. 1 with portions of the bed disassembled.

In accordance with the embodiment described herein, the bed 16 is modular and is formed of a plurality of modular pieces in the form of bed sections 16*a*, 16*b*, 16*c* and 16*d*, at least some of which are identical in construction. FIG. 8 shows in further detail the bed 16 with the first bed section 16*a* and second bed section 16*b* separated for purposes of clarity of exposition. As shown in FIGS. 7 and 8, the bed 16 includes three regular bed sections 16*a*, 16*b*, and 16*c*, and one end bed section 16*d*.

The first bed section 16*a* includes two rail sections 18*a*, 20*a* and two transverse bunk sections 24*aa* and 24*ab*. The rail sections 18*a*, 20*a* extend in parallel manner between the bunk sections 24*aa* and 24*ab*, and the bunk sections 24*aa* and 24*ab* extend in a parallel manner between the rail sections 18*a*, 20*a*. Thus, the rail sections 18*a*, 20*a* and bunk sections 24*aa*, and 24*ab* define a rectangular shape of the first bed section 16*a*. Moreover, in the embodiment described herein the first bed section 16*a* nearly forms a square shape, with the rail sections 18*a*, 18*b* having only a slightly greater length than that of the bunk sections 24*aa*, 24*ab*.

The rail sections 18*a*, 20*a* include corresponding track sections 22*a* on which the bearings 201, 202 and 203 of the carriage 12 roll. (See FIGS. 1, 5, 6). As will be discussed below, in detail, the bunk sections 24*aa* and 24*ab* are configured in this embodiment to facilitate various attachments, including attachment of the dog assembly 825, the vertical side supports 826, and the toe board 860 (see FIGS. 7, 9-11).

Referring specifically to FIG. 8, the first bunk section 24*aa* includes a flat plate 520, two sets of interconnection openings 522, two toe board connector openings 524, a plurality of toe board adjustment openings 526, and at least one lever opening 528. The flat plate 520 is a rigid, preferably steel sheet that extends between the rail sections 18*a*, 20*a*. The flat plate 520 is disposed such that its plate surfaces extend parallel to the vertical direction, and has a height that is rough equivalent to the height of the rail sections 18*a*, 20*a*.

The interconnection openings 522 in this embodiment are disposed near the ends (near rail sections 18*a*, 20*a*) of the flat plate 520. The two toe board connection openings 524 are disposed at positions roughly one-third the distance from either end of the flat plate 520, and at a height that is roughly centrally located between the bottom and top of the flat plate 520. The plurality of toe board adjustment openings 526 comprises a series of closely and linearly spaced openings configured to receive a pin. As will be discussed below, each position of the openings 526 corresponds to a different height at which the toe board 860 may be positioned. The series of closely spaced adjustment openings 526 are aligned in a horizontal line, slightly above the vertical level of the toe board connection openings 524 and between the toe board connection opening 524 and one end of the flat plate 520. The lever opening(s) 528 may suitably be located between the outermost toe board connection opening 524 and the nearest end of the flat plate 520.

Similarly, the second bunk section 24*ab* includes a flat plate 530, two sets of interconnection openings, not visible in FIG. 8, two toe board connector openings 534, a plurality of toe board adjustment openings 536, and at least one lever fulcrum opening 538. The flat plate 530 is similar in structure to the flat plate 520, and is therefore a rigid, preferably steel sheet that extends between the rail sections 18*a*, 20*a*. The flat plate 530 is disposed such that its plate surfaces extend parallel to the vertical direction, and has a height that is rough equivalent to, but higher than the height of the flat plate 520. The second bunk section 24*ab* further includes a top flange 542, and a bottom plate 544. The top flange 542 extends inwardly from, and is integrally formed with, the top edge of the flat plate 530. The bottom plate 544 is extends inwardly from, and is integrally formed with, the bottom edge of the flat plate 530.

The bottom plate 544 includes a thinner flange portion 546 and an end section 548. The thinner flange section 546 portion extends horizontally from one end of the flat plate to the end section 548. The end section 548 lies on the same plane as the thinner flange portion 546, but extends further inward from the flat plate 530. As will be discussed further below in connection with FIGS. 7, 8, 13 and 14, the end section 548 includes a central opening 550 through which a vertical side post may be received.

The set of interconnection openings on the flat plate 530 are disposed directly opposite of, and aligned with the set of interconnection openings 522 of the flat plate 520. Similarly, the two toe board connector openings 534 are disposed directly opposite of, and aligned with, the set of toe board connector openings 524. Likewise, the plurality of toe board adjustment openings 536 are disposed directly opposite of, and aligned with the set of toe board adjustment openings 526, and the at least one lever fulcrum opening 538 is disposed directly opposite of, and aligned with, the at least one lever fulcrum opening 528. The flat plate 530 also includes two bracket attachment openings located above the end section 548. In FIG. 8, the bracket openings are obscured from view by the bracket 558, which is attached to the flat plate 530 via placement of fasteners through the bracket openings. In FIG. 8, however, analogous bracket openings 552*b* are visible on the second bunk section 24*bb* of the second bed section 16*b*.

As discussed further above, the second bed section 16*b* and third bed section 16*c* preferably have an identical structure. For example, the second bed section 16*b* includes identical rail sections 18*b*, 20*b*, and identical bunk sections 24*ba* and 24*bb*, and the third bed section 16*c* includes identical rail sections 18*c*, 20*c*, and identical bunk sections 24*ca* and 24*cb*. The fourth bed section 16*d* in this embodiment has a substantially similar structure, including substantially identical rail sections 18*d*, 20*d*. The fourth bed section 16*d* primarily differs from the other bed sections 16*a*-16*c* in the selection and placement of the bunk sections. In any event, the fourth bed section 16*d* includes at least one identical first bunk section 24*da*.

When assembled, the bed sections 16*a*-16*d* are aligned such that the rail sections 18*a*-18*d* align in a substantially linear manner, and that the rails sections 20*a*-20*d* align in a substantially linear manner, thereby forming the completed rails 18 and 20. The bed sections 16*a*-16*d* are further aligned end-to-end, such that the second bunk section of a first bed section aligns with and is adjacent to (but slightly spaced apart from) a first bunk section of the next bunk section. Accordingly, for example, the second bunk section 24*ab* of the first bed section 16*a* aligns with and is adjacent to the first bunk section 24*ba* of the second bed section 16*b*. Similarly, the second bunk section 24*bb* of the second bed section 16*b* aligns with and is adjacent to the first bunk section 24*ca* of the third bed section 16*c*, and the second bunk section 24*cb* of the third bed section 16*c* aligns with and is adjacent to the first bunk section 24*da* of the fourth bed section 16*d*.

As discussed above, the first bunk sections 24*ba*, 24*ca* and 24*da* are substantially identical in structure to the first bunk section 24*aa* of the first bed section 16*a*. Similarly, the second bunk sections 24*bb* and 24*cb* are identical in structure to the second bunk section 24*ab* of the second bed section 16*b*. Thus, for example, the first bunk section 24*ba* of the second bunk section 16*b* includes a flat plate 520*b*, a set of interconnection openings 522*b*, two toe board connector openings 524*b*, a plurality of toe board adjustment openings 526*b*, and at least one lever opening 528*b*, all similar to the corresponding structures of the first bunk section 24*aa*, described further above.

Figure 9:
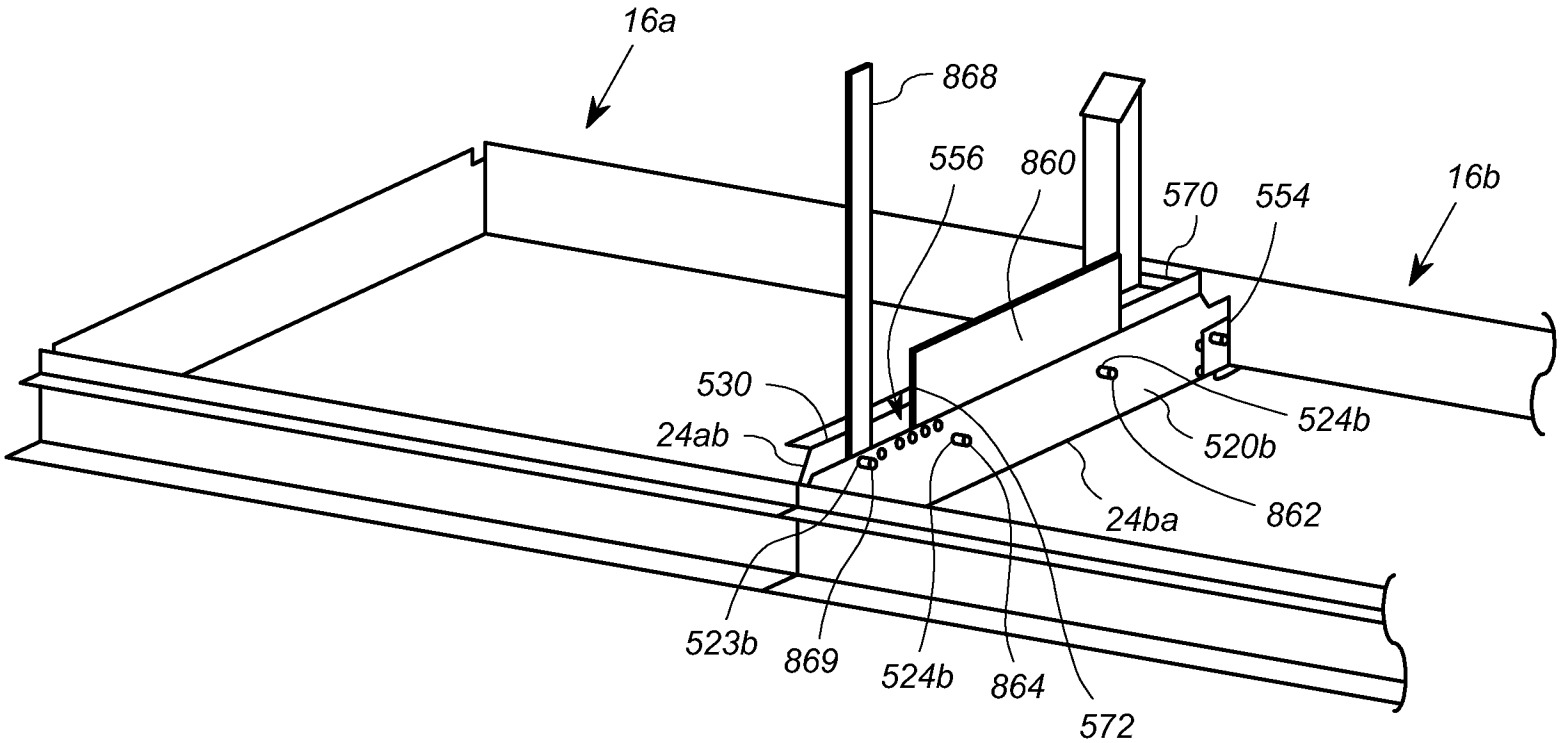
FIG. 9 shows a fragmentary perspective view of a portion of a bed with a toe board arrangement according to an embodiment of the invention.

Reference is now also made to FIG. 9, which provides further detail regarding the interaction of the bed sections 16*a* and 16*b*. FIG. 9 shows an enlarged, fragmentary, perspective view of the relevant portions of the bed sections 16*a*, 16*b* with a toe board 860 installed therein.

With reference to both FIGS. 8 and 9, bolts or other fasteners 554 connect the bed sections 16*a* and 16*b* via the interconnection openings of the second bunk section 24*ab* and the interconnection openings 522*b* of the first bunk section 24*ba*. The bolt or other fasteners 554 pass through the interconnection openings (e.g. 522*b*) to secure the first bed section 16*a* to the second bed section 16*b*. When assembled, there is a slight gap 556 between the first bunk section 24*ba* of the second bed section 16*b* and the second bunk section 24*ba* of the first bed section 16*a*. This gap 556 may be facilitated by any suitable structure on either bed section 16*a*, 16*b*, or using a spacer, not shown, on the fasteners 554.

It will be appreciated that the third bed section 16*c* is coupled to the second bed section 16*b* in an analogous manner, and that the fourth bed section 16*d* is also coupled to the third bed section 16*c* in an analogous manner.

Thus, the modular bed construction of this embodiment provides the added advantage of portability in that the bed 16 in this embodiment may be collapsed for ease of shipment, movement, or storage.

Referring again to FIG. 9, the bunk structure formed by the combination of a first bunk section (e.g. first bunk section 24*ba*) of one bed section and a second bunk section (e.g. bunk section 24*ab*) of the adjacent bed section provides a base or fixture from which the various other log supporting elements may be attached. In general, as shown in FIG. 8, the bunk sections 24*ba* and 24*bc* of the first and third bed sections 16*a*, 16*c* support vertical side support members 826. The second bunk section 24*bb* of the second bed section supports the moveable dog assembly 825. As shown in FIGS. 7 and 9, the first bunk section 24*ba* of the second bed section 16*b* and the section bunk section 24*ab* of the first bed section 16*a* further support the adjustable toe board 860.

Figure 10B:
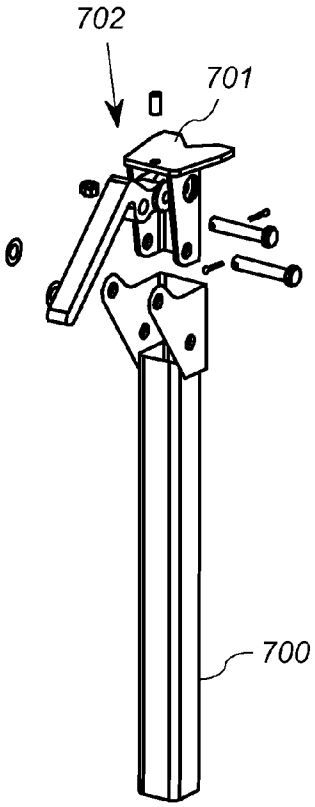
FIGS. 10*a* and 10*b* show perspective view of a log dog assembly that may be used in the portable saw mill of FIG. 1.
Figure 10A:
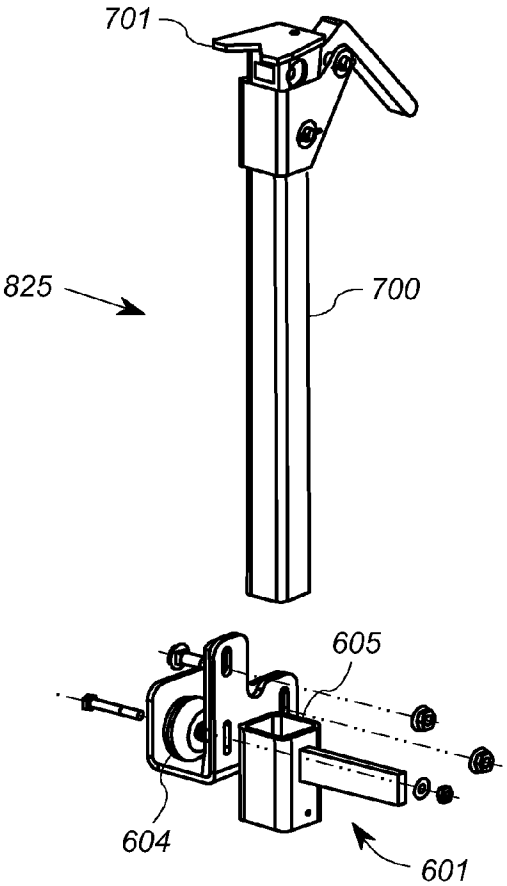

The dog assembly 825 is a moveable structure that is used, in part, to clamp the logs or timber against the side support members 826. In particular, FIGS. 10*a* and 10*b* show exploded perspective views of an exemplary embodiment of a dog assembly 825 that may be used in the bed 16. Referring to FIGS. 7, 8, 10*a* and 10*b*, the dog assembly 825 includes clamp teeth 701 configured to engage and urge a log in the direction of the vertical side support members 826. The dog assembly 825 further includes a vertical post 700, a dog slider assembly 601 and a dog cam assembly 702. FIG. 10*b* illustrates a portion of the dog assembly without the dog slider assembly 601.

Referring to FIG. 10*a*, the dog slider assembly 601 includes a post receiver tube 605 configured to receive the vertical post 700, and a roller bearing 604 operably coupled to the receiver tube 605. The roller bearing 604 is configured to move the dog slider assembly 601 across the thinner flange portion 546 to a position in which it engages the log. The receiver tube 605 is configured to allow for vertical adjustment of the vertical post 700.

Referring also to FIG. 10*b*, the clamp teeth 701 are affixed to the top of the vertical post 700 via the dog cam assembly 702. The dog cam assembly 702 is configured to facilitate clamping movement and retention of the clamp teeth 701 toward and away from the log, not shown, relative to the vertical post 700. Thus, the clamp teeth 701 may be moved horizontally with the post 700 via the roller bearing 604, and slightly more via the dog cam assembly 702. The clamp teeth 701 may be moved vertically with the post 700 within the receiver tube 605. Further details of the construction of the dog cam assembly 702 and dog slider assembly 601 may take several forms, and are omitted for purposes of clarity of exposition.

In accordance with the embodiment described herein, however, the dog assembly 825 may be used on any of the second dog sections 24*ba*, 24*bb* and 24*bc* of any of the bed sections 16*a*, 16*b* and 16*c*, because each have the uniform construction including the thinner flange portion 546 on which the dog slide assembly 601 is slidably mounted.

Figure 11A:
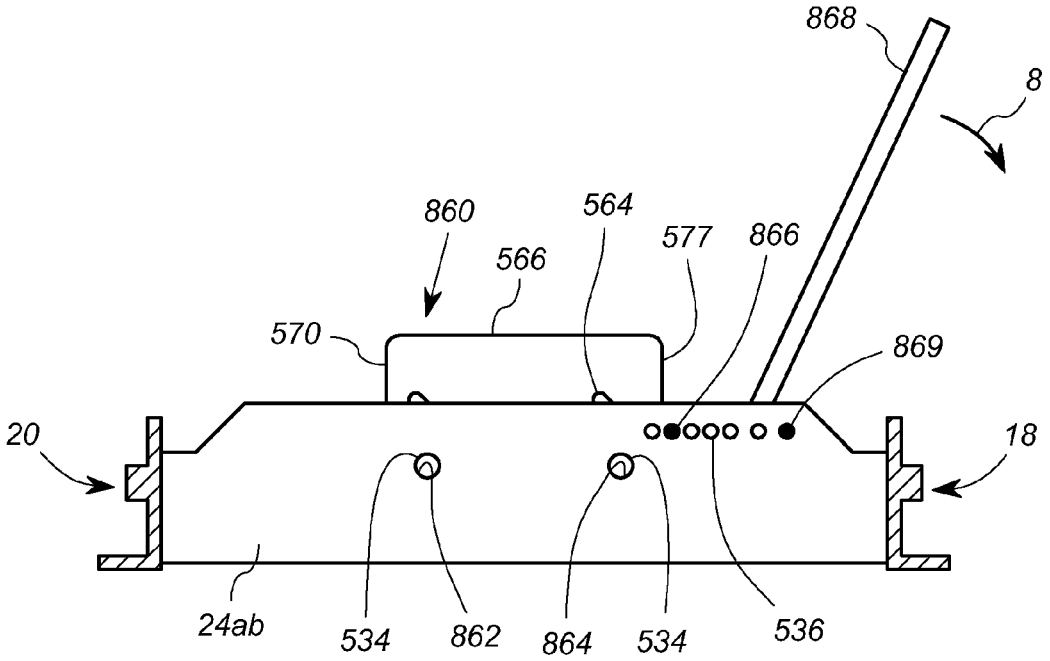
FIG. 11*a* shows a front plan view of the toe board arrangement of FIG. 9 with the toe board in a first position.
Figure 12:
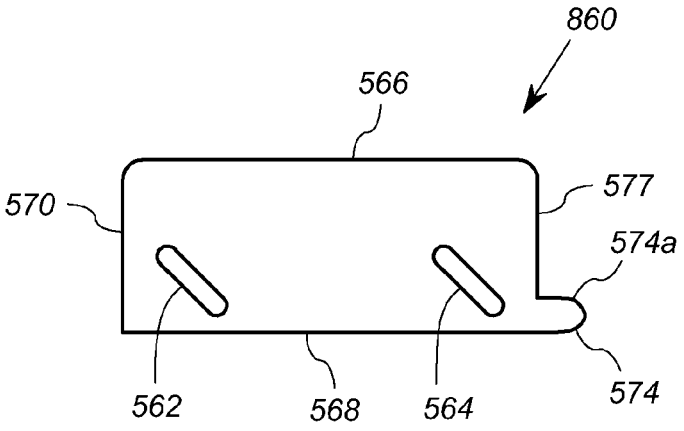
FIG. 12 shows a front plan view of a toe board of the toe board arrangement of FIG. 9.
Figure 11B:
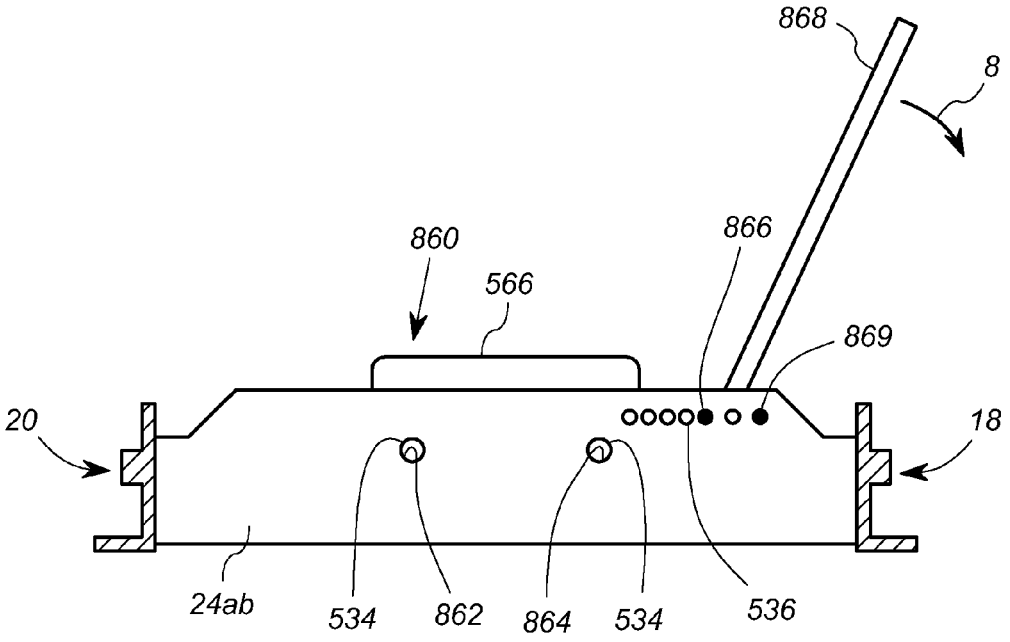
FIG. 11*b* shows a front plan view of the toe board arrangement of FIG. 9 with the toe board in a second position.

Referring again to the toe board 860, FIGS. 11*a* and 11*b* show a front plan view of the second bunk section 24*ba* with the toe board 860 assembled therewith. FIGS. 11*a* and 11*b* show the adjustable toe board 860 at two different heights. FIG. 12 shows a front plan view of the toe board 860 apart from other structures.

As mentioned further above, the purpose of the toe board 860 is to provide, if necessary, a raised resting surface for a part of the log in order to provide a level wood surface that accounts for nature taper of logs. Accordingly, the main purpose of the toe board 860 is to provide a height-adjustable surface or edge upon which a log may rest.

Referring briefly to FIG. 12, the toe board 860 includes a substantially planar member having two inclined slots 562, 564 formed therein. The toe board 860 is generally rectangular, having top and bottom long edges 566, 568 and first and second short edges 570, 572. In addition to the generally rectangular shape, the second short edge 572 includes a protruding member 574. The protruding member 574 extends outward from the second short edge 572 at the bottom, such that the bottom edge of the protruding member 574 is a collinear continuation of the bottom long edge 568. The second slot 564 extends diagonally from a location proximate the protruding member 574 to a point approximately halfway towards the top long edge 566, and in the lateral direction toward the first side edge 570. In general, however, the second slot 564 is on the right and lower quadrant of the toe board 860, nearest the bottom long edge 568 and second side edge 572. The first slot 562 extends in a manner parallel to, and is on the same vertical level as, the second slot. Therefore, both the first slot 562 and the second slot are at the same distances to the top long edge 566 and the bottom long edge 568. In contrast to the second slot 564, however, the first slot in located in the lower left quadrant, closer to the first long edge 570.

As shown most clearly in the rear perspective views of FIGS. 7 and 9, the toe board 860 is disposed between the parallel plates 530 and 520*b*, respectively, of the bunk sections 24*ba* and 24*ab*.

Referring again to FIGS. 11*a* and 11*b*, the toe board 860 is support by two pins 862, 864 and an adjustment pin 866. The two pins 862, 864 extend through the toe board connector openings 534 of the bunk section 24*ab*, the slots 562, 564, and the toe board connector openings 524*a* of the bunk section 24*ba* (See FIGS. 8 and 9). The adjustment pin 866 extends through a select one of the adjustment openings 536 of the bunk section 24*ab* and the corresponding adjustment opening 526 of the bunk section 24*ba*.

In general, the slots 562, 564 of the toe board 860 allows the toe board 860 to move diagonally up and down, thereby allowing for different vertical adjustments of the board 560. The adjustment pin 866 and the second side edge 572 cooperate to fix the toe board at a specific vertical level. To this end, it will be appreciated that as the toe board 860 moves downward, it also moves horizontally (right to left in FIGS. 11*a* and 11*b*). The horizontal aspect of the movement causes the second side edge 572 to engage the adjustment pin 866. The engagement of the second side edge 572 with the adjustment pin 866 stops the horizontal movement, and thus stops the vertical movement, of the toe board 860.

The toe board adjustment openings 526*b* and 536 allow the adjustment pin 866 to be moved to different horizontal locations, and thus allow the toe board 860 to be adjusted to different heights. For example, FIGS. 11*a* and 11*b* illustrate the toe board arrangement with the adjustment pin 866 located in different toe board adjustment openings 536. In FIG. 11*a*, the adjustment pin 866 is located two positions to the left as compared to the location of the adjustment pin 866 of FIG. 11*b*. As a consequence, the second side edge 572 in FIG. 11*b* can move further to the right because the pin 866 no longer stops it at the same location as that shown in FIG. 11*a*. As a consequence of the position further to the right, and as a result of the angled slots 562 and 564, the toe board 860 is also in a lower position. In other words, the toe board 860 has moved downward and to the right until the second side edge 572 again has engaged the adjustment pin 866. As a result, the top long edge 566 which supports the log is lower in FIG. 11*b* than it is in FIG. 11*a*, because the pin 866 is in a different position.

In this embodiment, the bunk sections 24*ab* and 24*ba* (as well as the other bunk sections in FIG. 7) have five adjacent adjustment openings 536, 526*a*, thereby allowing five different height levels of the toe board 860. It will be appreciated that more or less adjustment openings may be used, so long as the placement and range is compatible with the slots 562, 564 of the toe board 860.

In order to facilitate adjustment of the toe board, a flat level stick 868 may be employed. FIGS. 7, 9, 11*a* and 11*b* show a flat lever stick 868 in position to adjust the toe board 860. Specifically, for adjustment, the flat lever stick 868 is inserted between the bunk sections 24*ab* and 24*ba* such that one end, not visible in FIGS. 7, 9, 11*a* and 11*b*, engages the bulbous end 574*a* of the protrusion 574 (see FIG. 12). The lever stick 868 rests against a fulcrum pin 869 disposed through one of the lever fulcrum openings 538, 528*a*. Accordingly, pressing downward (clockwise in FIG. 11*a*) against the lever stick 868 causes the end within the bunk sections 24*ab*, 24*ba* to urge the protrusion 574 in the diagonal upward direction, thereby raising (and moving horizontally) the toe board 860. With the lever stick 868 supporting the toe board 860, the adjustment pin 866 may be removed, and replaced into another pair of the adjustment openings 536, 526*b* that corresponds to the new desired height. Once the adjustment pin 866 is in place, the force may be removed from the lever stick 868, and, the lever stick 868 removed. In general, the lever stick 868 is preferably completely removed before using the saw mill 10.

Accordingly, the present embodiment provides an efficient and effective mechanism for a height adjustable toe board 860 that does not require hydraulics or complex mechanical structures. It will be appreciated that the same principles may be used even if the bunk sections 24*ab*, 24*ba* are not part of a modular bed. For example, similar bunk sections may be employed in a saw mill that uses a single piece bed.

Another cost reduction of the embodiment described herein is the side vertical support members 826, which provide support to hold a log in place on the bed 16. The general purpose and function of side support members are known in the art. However, the side vertical support members 826 include improvements over the prior art side supports by avoiding the need for hydraulic or other inconvenient adjustment structures.

Another feature of the embodiment described herein is the adjustable vertical side support member arrangement. The design and function of the arrangement for adjustable side support members of the saw mill 10 is illustrated in FIGS. 7, 8, 13 and 14. Referring to FIG. 7, the side vertical support member 826 provides a stationary stop against which the log or timber to be cut is clamped. The clamping force is provided by the log dog 825, discussed further above. Thus, timber to be cut is held in place between (and by) the log dog 825 and the vertical side support member 826. It will be appreciated that the vertical side support member 826 must be lower than the cut line of the saw blade 41 (See FIG. 1). To accommodate the fact that timber may be of different thicknesses, the vertical side support member 826 is vertically adjustable. For example, FIGS. 7, 8 and 13 all show the vertical side support member 826 at different heights.

Figure 13:
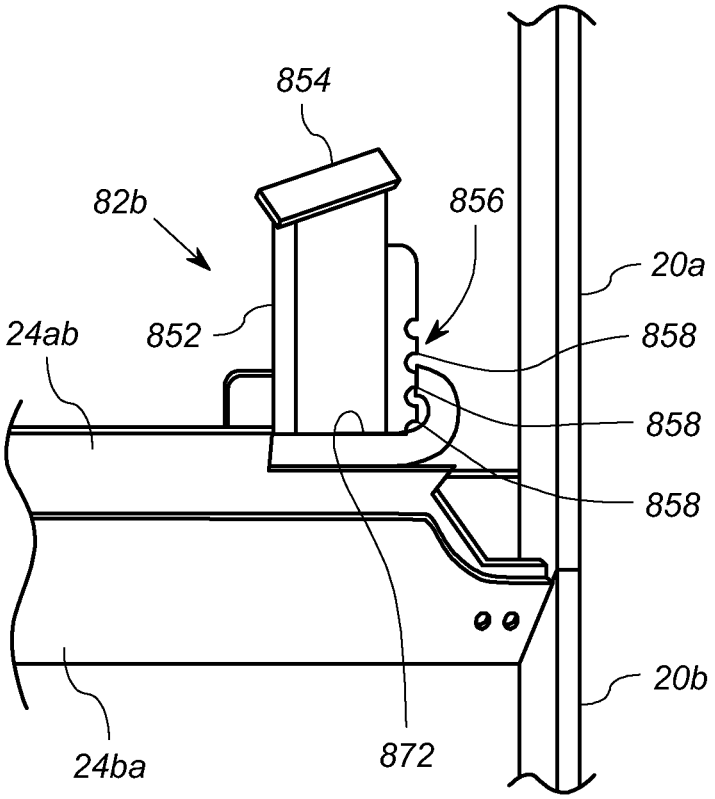
FIG. 13 shows a fragmentary perspective view of the bed of FIG. 7 illustrating the portion of the bed with the vertical side support member assembled thereto.

With reference to FIGS. 7, 8 and 13, each of the side support members 826 comprises a vertical tube 852 with an inclined, overhanging top plate 854, and a side rib structure 856. The side rib structure 856 extends over a large majority of the length of the vertical tube 852 and is affixed along a center line of one side thereof. The side rib structure 856 includes a plurality of teeth 858.

Figure 14:
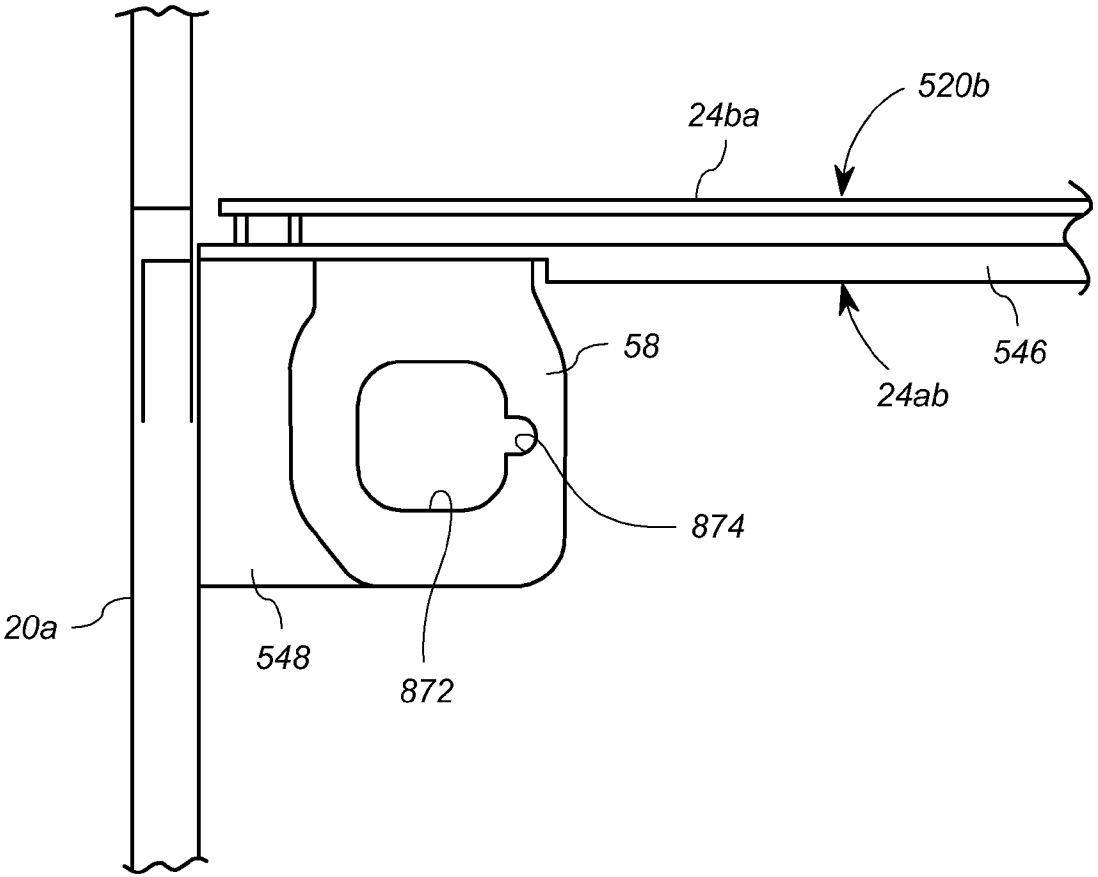
FIG. 14 shows a fragmentary top plan view of the portion of the bed of FIG. 7 that supports the vertical side support member of FIG. 13.

The arrangement for supporting the side support members 826 on the bed 16 is also shown in FIG. 14. FIG. 14 is a fragmentary top plan view of a portion of the bed 16 including the structures that support one of the side support members 826. With reference to FIGS. 7, 8, 13 and 14, the vertical side support member 826 sits within (and through) the central opening 550 of the end portion 548 of the bottom plate 544 of the bunk section 24*ab*, and through a central opening 872 of the bracket 558. The bracket 558 is affixed via fasteners secured within the openings 522 of the bunk section 24*ab*. It will be appreciate that if the bunk section 24*ab* is not intended to support a vertical side support member 826, then the bracket 558 may be removed. For example, as shown in FIG. 7, the bunk section 24*bb* does not include a bracket 558, nor a vertical side support member 826. By contrast the bunk sections 24*ab* and 24*cb* do include brackets 558 and side support members 826.

Referring again to FIG. 11, it can be seen that the teeth 858 of the vertical side support member 826 are configured to engage the edges of the central opening 872 (and/or central opening 550) to hold the vertical side support member 826 in a fixed vertical position. In particular, the width of the tube 852 itself is smaller than the diameter of the central openings 872, 550, thereby allowing for rotational movement of the tube 852. However, the teeth 858 extend outward such that the distance from the teeth 858 to the opposite wall of the tube 852 is wider than the nominal diameter of the central opening 872 and/or the central opening 550. Thus, the teeth 858 ordinary serve to inhibit vertical movement of the tube 852, but not rotational movement.

Nevertheless, the central opening 872 includes at least one notch 874 disposed at specific rotational position on the bracket 558 (See FIG. 14). The central opening 550 preferably has a similar notch, not shown, aligned with the notch 874. The notch 874 creates a portion of the central opening 872 that is wider than the distance from the teeth 858 to their opposing tube wall. As a consequence, when the tube 852 is rotated such that the teeth 858 align within the notch 874, the vertical side support member 826 may be vertically adjusted. When a proper height is reached, then the vertical side support member 826 may be rotated back to a position in which the teeth 858 engage the side of the central opening 872. As mentioned above the opening 550 may have the same structure as the opening 872.

It will be appreciated that the nominal preferred rotational position of the vertical side support member 826 is one in which the sloped top plate 854 is angled toward the interior of the bed 16. The sloped top plate 854 in this position helps guide the log onto the bed 16.

In addition to the above method of adjustment, it will be appreciated that the vertical side support member 826 and bracket 558 are configured to allow for a single lowest position in which the sloped top plate 854 is angled toward the exterior of the bed 16. This single lowest position is illustrated in FIG. 8. While this position lacks the advantage of having the sloped top plate 854 angled inward, it does provide a particularly low support level enabling low cuts to be made (e.g. of a thin piece of timber).

The operation of the saw mill 10 is described with initial reference to FIG. 1. Initially, a piece of timber, lumber or log, not shown, is placed on the bed 16 in an elongated manner such that it rests between the rails 18, 20. The log dog 825 is used to clamp the log or timber against the vertical side support members 826. Dependent on the level of cut and size of the piece of lumber or timber, the vertical side support members 826 may be raised or lowered. The height of the vertical side support members 826 is preferably selected such that they are below the vertical level the blade 41 during the cut, but high enough to provide strong side support to the log.

In addition, if the log or timber is tapered, then a toe board 860 may be used to raise one end of the log to provide a relatively level upper surface from which saw cuts may be made. To this end, the toe board 860 is first inserted between the bunk sections 24 near the end of the log that is to be raised. The toe board 860 is then adjusted to the desired height. In particular, consider an example in which the toe board 860 is to be inserted between bunk sections 24*ab* and 24*ba* as shown in FIGS. 7, 9, 11*a* and 11*b*). The pins 826, 864 are placed through the slots 562, 564 (see FIG. 12) and the lever 868 inserted between the bunk sections 24*ab* and 24*ba* as shown in FIGS. 7, 9, 11*a* and 11*b*). The lever 868 is rotated clockwise the perspective of FIGS. 11*a* and 11*b* until it engages the protruding member 574 (see FIG. 12). The lever 868 is further rotated clockwise moving the toe board 860 diagonally upward. The lever 868 is rotated until the desired height of the top edge 566 of the toe board 860 is reached. At that point, the adjustment pin 866 is placed in the left-most (from the perspective of FIGS. 11*a* and 11*b*) of the openings 536 (and 526*b*) that is not blocked by the toe board 860. The pressure on the lever 868 may be released and the lever 868 removed. The toe board 860 is then held at the desired height by the adjustment pin 866.

Once the lumber is secured and leveled on the bed 14, the operator, using the handle 219, operates the winch system 80 to raise and or lower the saw head 14 to the proper cut height with respect to the lumber. (See FIGS. 1, 3, 5 and 6). The engine 26 is started, which causes the rotation of the drive sheave 127. By properly engaging the clutch assembly 123, the rotation of the drive sheave 127 imparts rotation via the drive belt 138 to the second band wheel 64. By properly tensioning the blade 41 via the tensioner unit 62, the rotation of the second band wheel 64 causes rotation of the blade 41 about both band wheels 64, 104, which creates the band saw cutting motion.

The operator then, standing behind the carriage 12 and using the handle 218, moves the carriage 12 (and hence the saw head 14) in the direction from the first end 40 to the second end 41 into the lumber disposed on the bed 16. To this end, the bearing 201, 202 and 203 facilitate movement of the carriage 12 along the tracks 22 of the rails 18, 20. The cutting motion of the blade 41 cuts the lumber as the carriage 12 and saw head 14 move toward the second end 42 of the saw mill 10.

The above-described embodiment includes various inventive improvements, each of which may provide advantages in other embodiments without inclusion of other improvements. It will be appreciated that the above-describe embodiments are merely exemplary, and that those of ordinary skill in the art may readily devise their own implementations and adaptations that incorporate the principles of the present invention and fall within the spirit and scope thereof.

It will further be appreciated that in alternative embodiment, the bed assembly may include attached or detachable wheels and axles to facilitate portability. To this end, the bed 16 in such an embodiment may further include a hitch assembly, an axle, a pair of wheels and suitable fender structures.

I claim:

1. A log adjustment system for a portable saw mill having a saw head and a bed, comprising:

a pair of substantially parallel elongate supports;

a first transverse member extending between the elongate supports;

a second transverse member extending parallel to the first transverse member, an adjustable toe board extending in a gap defined between the first transverse member and the second transverse member, the adjustable toe board configured to be supported at a plurality of heights adjacent the first and second transverse members.

2. The log adjustment system of claim 1, further comprising a plurality of pins, and wherein:

the first and second transverse members include a plurality of throughholes for receiving the plurality of pins;

the toe board includes a plurality of throughholes through which the plurality of pins pass.

3. The log adjustment system of claim 2, wherein each of the toe board throughholes includes a slot, wherein the slots are configured to receive the plurality of pins in a plurality of locations.

4. The log adjustment system of claim 3, wherein the throughholes of the first and second transverse members are configured to retain the plurality of pins in a single location with respect to the first and second transverse members.

5. The log adjustment system of claim 2, wherein:

one of the first transverse member and the toe board includes a slot having multiple positions for receiving one of the plurality of pins; and the other of the first transverse member and the toe board is configured to receive the one of the plurality of pins in a single position.

6. The log adjustment system of claim 5, wherein the first and second transverse member further comprise a second plurality of throughholes, each of the second plurality of throughholes configured to receive an adjustment pin therethrough.

7. The log adjustment system of claim 6, wherein the adjustment pin engages an outer edge of the toe board, and wherein a height of the toe board depends a throughhole of the second plurality of throughholes through which the adjustment pin extends.

8. The log adjustment system of claim 1, wherein:

a first support of the pair of substantially parallel elongate supports comprises at least a first rail section and a second rail section;

a second support of the pair of substantially parallel elongate supports comprises at least a first rail section and a second rail section;

the first rail section of the first support, the first rail section of the second support and the first transverse member form at least in part a first bed section;

the second rail section of the first support, the second rail section of the second support, and the second transverse member form at least in part a second bed section; and at least one fastener coupling the first bed section to the second bed section.

9. The log adjustment system of claim 8, wherein the first bed section and the second bed section are substantially identical.

10. The log adjustment system of claim 9, wherein the first and second transverse member further comprise a plurality of throughholes, each of the plurality of throughholes configured to receive an adjustment pin therethrough, each of the plurality of throughholes cooperating with the adjustment pin to retain the toe board at one of a plurality of heights.

11. The log adjustment system of claim 10, wherein the adjustment pin engages an edge of the toe board to retain the toe board at the one of the plurality of heights of the toe board.

12. The log adjustment system of claim 1, wherein the first and second transverse member further comprise a plurality of throughholes, each of the plurality of throughholes configured to receive an adjustment pin therethrough, each of the plurality of throughholes cooperating with the adjustment pin to retain the toe board at one of a plurality of heights.

13. The log adjustment system of claim 10, wherein the adjustment pin engages an edge of the toe board to retain the toe board at the one of the plurality of heights of the toe board.

14. The log adjustment system of claim 4, wherein the first and second transverse member further comprise a second plurality of throughholes, each of the second plurality of throughholes configured to receive an adjustment pin therethrough.

15. The log adjustment system of claim 14, wherein each of the slots extends in an inclined manner, and wherein the adjustment pin engages an outer edge of the toe board.

16. The log adjustment system of claim 2, wherein at least a first pin of the plurality of pins extends through a throughhole of the first transverse member and a throughhole of the second transverse member.

17. The log adjustment of claim 1, wherein the adjustable toe board is configured to be supported at a first of the plurality of heights by at least one pin extending from the first transverse member to the second transverse member.

* * * * *